US005258684A

United States Patent [19]

Matesco

[11] Patent Number: 5,258,684

[45] Date of Patent: Nov. 2, 1993

[54] SPARK PLUG FOR AN INTERNAL COMBUSTION ENGINE

[75] Inventor: Michel Matesco, Saint Etienne, France

[73] Assignee: Eyquem, Nanterre Cedex, France

[21] Appl. No.: 765,037

[22] Filed: Sep. 24, 1991

[30] Foreign Application Priority Data

Sep. 26, 1990 [FR] France ..... 90 11879

[51] Int. Cl.[5] ..... H01T 13/04; H01R 13/44

[52] U.S. Cl. ..... 313/141; 313/135; 439/127

[58] Field of Search ..... 313/135, 141; 439/125, 439/127, 128

[56] References Cited

U.S. PATENT DOCUMENTS 1,635,186 7/1927 Littleton .
1,996,421 4/1935 Hurley .
2,292,216 8/1942 Doran ..... 313/135 X
3,370,331 2/1968 Beardslee, Jr. .

*Primary Examiner*—Sandra L. O'Shea
*Attorney, Agent, or Firm*—Wenderoth, Lind & Ponack

[57] ABSTRACT

A spark plug for an internal combustion engine has a center electrode and at least one side electrode defining between them a spark gap. The end of the center electrode opposite the spark gap is in the form of a rod carrying a connection piece for connection to the ignition circuit. The connection piece, which is made of a metal which is a good conductor of electricity, is force-fitted on the end rod of the center electrode.

7 Claims, 1 Drawing Sheet

SPARK PLUG FOR AN INTERNAL COMBUSTION ENGINE

BACKGROUND OF THE INVENTION

The present invention relates to spark plugs for an internal combustion engine, and relates more particularly to connecting these plugs to the ignition circuit of the engine.

A spark plug generally has a center electrode and a side electrode, insulated from one another by a body of insulating material, such as ceramic, and the two electrodes having two mutually facing ends which define a spark gap.

At its opposite end, which is intended to be connected to the ignition circuit, the plug has a connection terminal connected to the center electrode.

This terminal is generally formed by a standardized piece, manufactured up to the present by two known techniques.

According to a first technique, the connection terminal is formed by a rod, the free end of which is threaded in accordance with ISO Standard 1919-1982. Mounted on this threaded end of the rod is a connection piece formed by a nut or threaded bush, in accordance with ISO Standard 1919-1982.

According to a second technique, the end rod of the electrode and the connection piece are made in one piece, by cold stamping or bar turning.

The connection terminal manufactured according to the first technique has the disadvantage of frequently coming unscrewed under the effect of the vibratory stresses of the combustion engine.

The connection terminal manufactured according to the second technique, the one-piece connection terminal, has the disadvantage, principally in the technique for mounting plugs referred to as "shrink-fitting" or "with conductive adhesive", of being covered by a layer of oxidized nickel, for example, which makes the fitting and removal of the electric supply leads of the plug particularly difficult.

SUMMARY OF THE INVENTION

The invention aims to remedy the disadvantages of the prior art by creating a connection terminal for a spark plug which, while being less expensive to manufacture, permits easy fitting and removal of the supply lead and presents reduced risks of oxidation.

It thus relates, to a spark plug for an internal combustion engine that comprises a center electrode and at least, one side electrode defining between them a spark gap. The end of the center electrode opposite the spark gap is in the form of a rod carrying a piece for connection to the ignition circuit. The connection piece, which is made of a metal which is a good conductor of electricity, is force-fitted on the end rod of the center electrode.

According to a particular feature of the invention, the external surface of the end rod of the center electrode has reliefs, and the connection piece has a smooth bore force-fitted on the external surface provided with the reliefs.

BRIEF DESCRIPTION OF THE DRAWING

The invention will be better understood with the aid of the description below, provided solely by way of example and given with reference to the attached drawings, in which.

DETAILED DESCRIPTION OF THE PREFERRED EMBODIMENT

Figure 1:
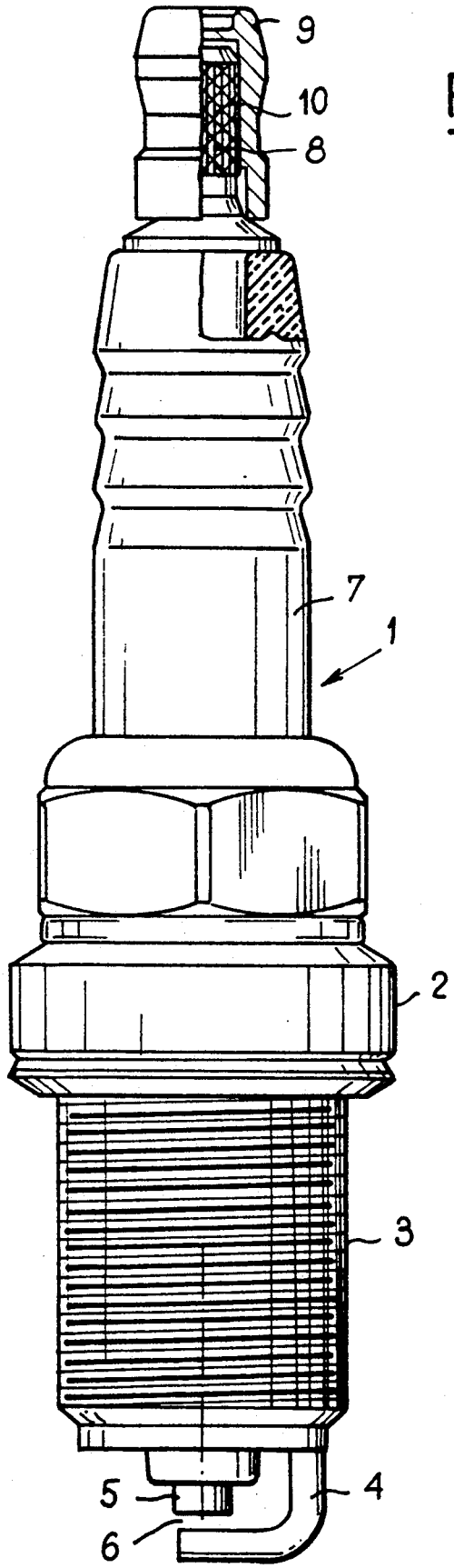
FIG. 1 is a view in elevation and in partial section of a spark plug improved according to the invention.

FIG. 1 shows a spark plug 1 having a metallic shell 2 provided with an external thread 3 for mounting the plug and with a curved side electrode 4 cooperating with a center electrode 5 so as to define a spark gap 6.

The side electrode 4 is insulated from the center electrode 5 by a sleeve 7 of insulating material, such as ceramic.

At its end opposite the spark gap 6, the center electrode 5 has a rod 8 which projects beyond the insulator 7 and is intended to allow the plug to be connected to an ignition circuit.

The rod 8 carries a connection piece 9 with a standardized external profile, intended to cooperate with a split bush of complementary profile or with a clamp of a female connector fixed to the end of a lead for connecting the plug to the ignition circuit (not shown).

The external surface of the rod 8 has a knurled profile 10, or other reliefs.

Figure 2:
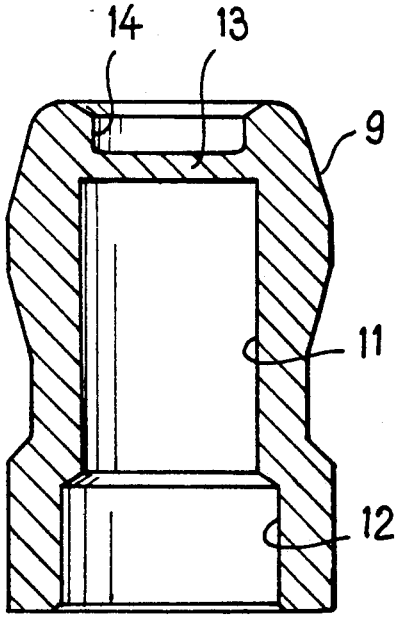
FIG. 2 is view in elevation and in section of a connection piece of the spark plug of FIG. 1.

As can be seen more clearly in FIG. 2, the connection piece 9 has a smooth and blind central bore 11 which opens at its free end into a hole 12 of larger diameter.

The base 13 of the central bore 11 likewise forms the base of a recess 14 provided at the opposite end of the connection piece to the hole 12 of larger diameter, the recess being intended to receive a spot of color serving for the location of the connection at its upper end.

The connection piece is advantageously manufactured by bar turning, cold stamping, casting or some other method, in one of the usual materials such as "Zamak", low-carbon steel, brass, bronze or copper. The connection piece 9 is fixed on the knurled end rod 8 of the center electrode of the plug by force-fitting, performed by exerting a force on the top of the connection piece 9.

In this way, an assembly which resists a tear-off force greater than 100 daN is obtained.

Although, in the arrangement according to the invention, the process for manufacturing the connection rod 8 remains virtually unmodified, the connection piece 9, on the other hand, benefits from the elimination of the threading operation. The result of this is thus a lower cost of manufacture.

A spark plug having a connection terminal of its center electrode manufactured according to the invention meets the new quality requirements of motor vehicle manufacturers particularly well, while permitting the use, at lower cost, of connections made of materials which are good conductors, such as brass.

It furthermore benefits from all the advantages conferred by a separate connection piece, such as a threaded piece, without having its disadvantages.

I claim:

1. A spark plug for an internal combustion engine, comprising:

a center electrode having opposite ends; and at least one side electrode, said side electrode and one said end of said center electrode defining a spark gap therebetween;

wherein the other said end of said center electrode defines an end rod and carries a connection piece made of metal thereon for connecting said spark plug to an ignition circuit; and wherein said connection piece is force-fitted on said end rod of said center electrode.

2. The spark plug of claim 1, wherein said end rod of said center electrode has an external surface with reliefs and wherein said connection piece has a smooth bore in force-fitted engagement with said external surface and said reliefs.

3. The spark plug of claim 2, wherein said reliefs on said external surface of said end rod of said center electrode comprise knurls.

4. The spark plug of claim 3, wherein said smooth bore of said connection piece has an end wall facing the other said end of said center electrode, said end wall further having an opposite side facing away from the other said end of said center electrode, and said connection piece further defining a recess facing away from the other said end of said center electrode having said opposite side of said end wall as a base thereof.

5. The spark plug of claim 4, wherein said recess has a locating mark therein.

6. The spark plug of claim 2, wherein said smooth bore of said connection piece has an end wall facing the other said end of said center electrode, said end wall further having an opposite side facing away from the other said end of said center electrode, and said connection piece further defining a recess facing away from the other said end of said center electrode having said opposite side of said end wall as a base thereof.

7. The spark plug of claim 6, wherein said recess has a locating mark therein.

* * * * *